US010610427B2

(12) United States Patent
MacDonald et al.

(10) Patent No.: US 10,610,427 B2
(45) Date of Patent: Apr. 7, 2020

(54) MILITARY STRETCHER SYSTEM

(71) Applicant: Aero Medical Engineering Pty Ltd, Brisbane, QLD (AU)

(72) Inventors: Brian MacDonald, Brisbane (AU); Dijon Johnson, Brisbane (AU); Jason Stephenson, Brisbane (AU); Michael Hinchy, Brisbane (AU); Glenn McKay, Brisbane (AU); Paul Alexander Ceprnich, Brisbane (AU); Kirby James Nankivell, Brisbane (AU); Jack Nelson Beet, Brisbane (AU)

(73) Assignee: AERO MEDICAL ENGINEERING PTY LTD, Brisbane, Queensland (AU)

( * ) Notice: Subject to any disclaimer, the term of this patent is extended or adjusted under 35 U.S.C. 154(b) by 454 days.

(21) Appl. No.: 14/804,946

(22) Filed: Jul. 21, 2015

(65) Prior Publication Data

US 2016/0022515 A1 Jan. 28, 2016

(30) Foreign Application Priority Data

Jul. 22, 2014 (AU) ..... 2014902833
Aug. 25, 2014 (AU) ..... 2014903335

(51) Int. Cl.
*A61G 1/06* (2006.01)
*A61G 1/04* (2006.01)
(Continued)

(52) U.S. Cl.
CPC ..... *A61G 1/06* (2013.01); *A61G 1/04* (2013.01); *A61G 1/042* (2016.11); *A61G 1/048* (2013.01);
(Continued)

(58) Field of Classification Search
CPC ..... A61G 1/06; A61G 1/042; A61G 1/048; A61G 3/0841; A61G 3/0858; A61G 1/04;
(Continued)

(56) References Cited

U.S. PATENT DOCUMENTS 4,115,884 A * 9/1978 Keogh ..... A61G 3/00 296/19
4,178,032 A 12/1979 Hone
(Continued)

FOREIGN PATENT DOCUMENTS

DE 8604145 U1 4/1986
DE 19732724 A1 2/1999
(Continued)

OTHER PUBLICATIONS

Extended European Search Report; European Application No. 15177928.7; dated Nov. 19, 2015; 17 pages.
(Continued)

*Primary Examiner* — Peter M. Cuomo
*Assistant Examiner* — Myles A Throop
(74) *Attorney, Agent, or Firm* — Hunter Clark PLLC

(57) ABSTRACT

The present invention relates to a military stretcher system. The system includes a military hand-carried stretcher. An adaptor is provided for adapting the stretcher to fasten to a military transportation stretcher holder, typically used on vessels and in vehicles and in aircraft. Advantageously, the adaptor may adapt the stretcher to fasten to the holder (e.g. a racking system) conventionally used to hold a known NATO type stretcher.

18 Claims, 12 Drawing Sheets

(51) Int. Cl.
*A61G 3/08* (2006.01)
*A61G 1/048* (2006.01)
*A61G 3/00* (2006.01)

(52) U.S. Cl.
CPC ..... *A61G 3/0825* (2013.01); *A61G 3/0841* (2013.01); *A61G 3/0858* (2013.01); *A61G 3/0883* (2013.01); *A61G 3/0891* (2013.01); *A61G 3/001* (2013.01); *A61G 2220/10* (2013.01)

(58) Field of Classification Search
CPC .. A61G 3/0891; A61G 3/0825; A61G 3/0883; A61G 2220/10; A61G 3/001; A47C 17/80; A64G 7/0504; A64G 7/0507; A64G 7/05
See application file for complete search history.

(56) References Cited

U.S. PATENT DOCUMENTS 5,274,864 A 1/1994 Morgan
5,626,151 A 5/1997 Linden
5,813,629 A * 9/1998 Cabrera ..... A61G 3/0825 244/118.5
5,918,331 A 7/1999 Hall et al.
5,975,081 A * 11/1999 Hood ..... A61G 1/00 128/845
6,374,438 B1 4/2002 Fox et al.
6,488,029 B1 12/2002 Hood et al.
7,022,094 B2 * 4/2006 Buckman ..... A61F 5/0585 602/23
8,308,212 B2 * 11/2012 Schrand ..... A61G 1/0565 296/18
8,746,771 B1 6/2014 Farber
2007/0157389 A1 7/2007 Eriksson
2008/0023976 A1 * 1/2008 Myers ..... A61G 3/0254 296/19
2009/0255058 A1 * 10/2009 Chinn ..... A47C 17/80 5/118
2011/0260483 A1 * 10/2011 Chinn ..... A61G 1/0562 296/20
2012/0006873 A1 * 1/2012 Chinn ..... A61G 3/0841 224/545
2012/0205934 A1 8/2012 Fletcher et al.
2014/0082844 A1 3/2014 Bertsch
2014/0092844 A1 3/2014 Bertsch
2014/0117063 A1 * 5/2014 Sartin ..... A61G 3/0825 224/547

FOREIGN PATENT DOCUMENTS

DE 10121130 A1 1/2003
EP 2260816 A2 12/2010
EP 2366369 A2 9/2011
EP 2442774 A1 4/2012
FR 2989574 A1 10/2013

OTHER PUBLICATIONS

Innovation Patent Examination Report No. 1 dated May 8, 2015 relating to AU Patent Application No. 2015100190.
Innovation Patent Examination Report No. 1 dated Dec. 4, 2014 relating to AU Patent Application No. 2014101193.

* cited by examiner

MILITARY STRETCHER SYSTEM

CROSS REFERENCE TO RELATED APPLICATIONS

This application claims priority to Australian Patent Application No. 2014902833 filed on Jul. 22, 2014 and Australian Patent Application No. 2014903335 filed on Aug. 25, 2014, each of which is incorporated by reference herein in their entirety.

TECHNICAL FIELD

The present invention generally relates to a military stretcher system, and in particular to an aero-medical military stretcher system.

BACKGROUND

The reference to any prior art in this specification is not, and should not be taken as an acknowledgement or any form of suggestion that the prior art forms part of the common general knowledge.

Medevac field stretchers commonly known as NATO type stretchers are designed in accordance with NATO and other military standards and are used in the evacuation of military or other casualties (e.g. during a natural disaster) to hospital in a helicopter or aeroplane. A NATO type military field stretcher includes a pair of rails terminating in handles, and a carrier sheet (normally canvass) extending between the rails to carry a patient. In practice, loaded NATO type stretchers are rested on fixed racking in aircraft during air transportation.

However, the applicant has perceived that NATO type stretchers are less than ideal. Whilst improved stretchers are available to improve the comfort and security of a transported patient, the use of standard aircraft restraints and racking systems to suit the NATO type stretcher has impeded the use of such improved stretchers in medevac operations. This issue is particularly significant when considering the widespread adoption of these restraints and racking systems throughout the full suite of military transportation assets, on land, at sea and in aviation.

The applicant also recognizes the deficiencies of the present NATO type stretchers in use, including but not limited to the following deficiencies. The NATO type stretcher exhibits:

a. inability to properly and readily inspect damage to the stretcher (due to its cover materials encasing the side rails)—to ensure that there has been no impact damage, or fatigue or stress induced potential structural failure points;

b. inability to properly restrain the stretchered patient by the use of modern standard patient multi-point restraint belts so that the patient is restrained by suitable means to withstand rapid and major motion events (such as evasive maneuvers or major turbulence) and/or crash events—to improve patient survivability in all threat environments;

c. inability for the stretchered patient to be seated or placed in a variable upright position to provide optimum patient care;

d. inability to clean and ensure that any biological contamination on the stretcher has been eradicated—due to its materials of construction; and e. inability to readily provide ballistic protection to the stretchered patient other than by the patient wearing suitable ballistic protective clothing, which significantly interferes with the provision of optimum patient care.

Embodiments of the present invention provide for improved stretchers and associated devices in medevac operations.

SUMMARY OF THE INVENTION

According to a first aspect of the present invention, there is provided a military stretcher system including:

a military hand-carried stretcher; and an adaptor for adapting the stretcher to fasten to a stretcher holder of a military transportation vehicle.

Advantageously, the adaptor may adapt the hand-carried stretcher to fasten to the holder conventionally used to hold a known NATO type stretcher. The holder may include aircraft racking.

Preferably, the stretcher includes carbon fibre material. The stretcher may include other material (such as Kevlar for example). The stretcher may be lightweight, not weighing more than 15 kg, and preferably less than 10 kg. The stretcher may include a carbon fibre composite chassis. The chassis may be molded. The stretcher may further include a backrest or headrest. The stretcher may further include a lifter for lifting the rest from the chassis to an inclined position. The lifter may include a sealed gas strut. The stretcher may also include a support mattress, for patient comfort during stretchering. The stretcher material may be fire or flame resistant.

The stretcher may include at least one pin for being received in a receptacle of the adaptor. The stretcher may include a locking actuator for locking the stretcher to the adaptor. The actuator may be a hydraulic actuator.

The adaptor may include a frame. The frame may include a pair of rails for extending between arms of the holder. The adaptor may include one or more docks for docking the stretcher. Each dock may include a tapered guide for guiding a sliding stretcher. Each dock may define at least one female receptacle for receiving a pin of the stretcher. The receptacle may be retractable. The adaptor may include a quartet of rests.

The system may include at least one male-female fastening arrangement for fastening the stretcher to the adaptor. The system may include a locking mechanism for locking the stretcher to the adaptor. The locking mechanism may include a retractable locking pin for being received by the adaptor.

The adaptor may include a ballistic shield for shielding ballistic material (e.g. bullets or shrapnel). The shield may be releasably fastened to an underside of the adaptor. The shield may clip to the adaptor. The shield may include a sheet. The sheet may receive replacable inserts of ballistic protection material. The ballistic protection material may include carbon fibre and/or Kevlar and/or ceramic material of suitable composite construction to protect the patient on the stretcher.

The system may further include a medical life support module for interconnecting between the adaptor and stretcher. The medical module may include a life support system. The medical module may include an oxygen tank and regulator, and/or suction systems. The medical module may also include a power inverter and supply outlets.

The system may further include another adaptor for adapting a non-military stretcher (e.g. conventional civilian stretcher) to fasten to the adaptor. The adaptors may form a locking arrangement for releasably locking together. The other adaptor may include a guide for guiding wheels of the non-military stretcher. The guide may include a pair of channel rails. The other adaptor may include a fastening mechanism for fastening the non-military stretcher. The fastening mechanism may include at least one catch. The catch may be retractable.

The system may further include a workbench for fastening to the adaptor. The workbench may include carbon fibre, Kevlar or metal alloys.

The system may further include the racking system. The racking may include a pair of arms for supporting the adaptor. Each arm may include one or more receptacles for receiving respective handles of the adaptor.

According to a second aspect of the present invention, there is provided a military adaptor for adapting a military hand-carried stretcher to fasten to a military transportation stretcher holder.

According to a third aspect of the present invention, there is provided an adaptor system including the military adaptor, and another adaptor for adapting a non-military stretcher (e.g. conventional civilian stretcher) to fasten to the adaptor.

According to a fourth aspect of the present invention, there is provided an adaptor configured to adapt a non-military stretcher (e.g. conventional civilian stretcher) to fasten to a military adaptor.

According to a fifth aspect of the present invention, there is provided a military hand-carried stretcher configured to be fastened to an adaptor, in turn, fastened to a military transportation stretcher holder.

According to a sixth aspect of the present invention, there is provided a military evacuation method involving:

fastening an adaptor to a military transportation stretcher holder; and fastening a military hand-carried stretcher to the adaptor.

According to a seventh aspect of the present invention, there is provided a military stretcher system including:

a military hand-carried stretcher; and a military transportation dock for docking the hand-carried stretcher.

According to an eight aspect of the present invention, there is provided a medical stretcher including a carbon fibre composite frame and/or chassis.

Advantageously, carbon fibre composite stretchers are lightweight when compared with conventional steel, alloy or aluminum stretchers. Preferably, the stretcher is a hand-carried stretcher which is carried by hand when loaded.

The stretcher may include an impermeable patient support fastened to the frame which is more readily cleaned and more sanitary than fabric of NATO type-stretchers. The patient support may include carbon fibre composite material. The patient support may include cutouts though which seatbelts can advantageously pass to secure the patient. The frame may be at least partially exposed which advantageously allows ready visual inspection or damage. The stretcher may further includes a movable backrest or head rest for patient comfort. The stretcher may further include a lifter for lifting the backrest or headrest. The lifter may be hydraulic. The stretcher may include underside locking arrangements for locking the stretcher in place.

According to a ninth aspect of the present invention, there is provided a stretcher system including:

a medical life support module; and a medical stretcher for coupling to the life support module.

According to a tenth aspect of the present invention, there is provided a life support module including a coupler for coupling a medical stretcher. The coupler may include a docking arrangement. The coupler may include a lock.

Any of the features described herein can be combined in any combination with any one or more of the other features described herein within the scope of the invention.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
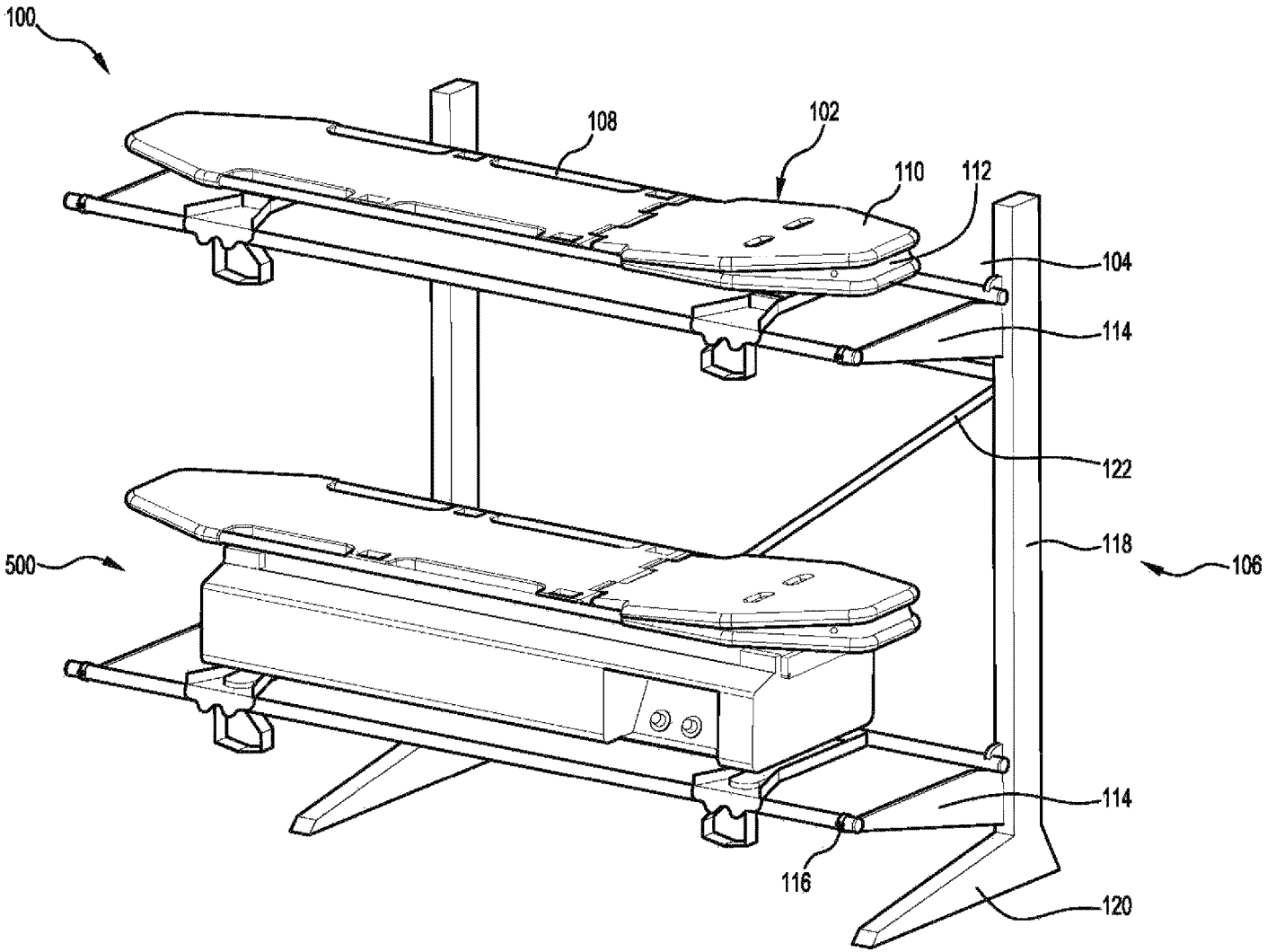
FIG. 1 is a perspective view of an aero-medical stretcher system according to an embodiment of the present invention.

According to an embodiment of the present invention, there is provided an aero-medical military stretcher system 100 for front-line services as shown in FIG. 1. The system 100 includes an improved military field medical stretcher 102 (see also FIG. 7) for carrying a patient. The system 100 further includes an intermediate adaptor 104 for adapting the stretcher 102 to fasten to internal military aircraft racking 106 (i.e. stretcher holder). Advantageously, the adaptor 104 adapts the field stretcher 102 to fasten to the aircraft racking 106 which is conventionally used to support a known NATO type military field stretcher.

The stretcher 102 includes a molded carbon fibre composite chassis 108 including carbon fibre and Kevlar. The stretcher 102 is extremely lightweight, not weighing more than 15 kg, and preferably less than 10 kg. The stretcher 102 further includes a pivoting backrest (or head rest) 110 to enable the patient to sit up for optimum care. The stretcher 102 further includes a pneumatic, hydraulic or electric lifter 112 for lifting the rest 110 from the chassis 108 and to an inclined position. The lifter 112 includes a retractable sealed gas strut. The stretcher 102 also includes a support mattress (not shown), for patient comfort during stretchering. The stretcher materials can be fire or flame resistant.

Figure 2:
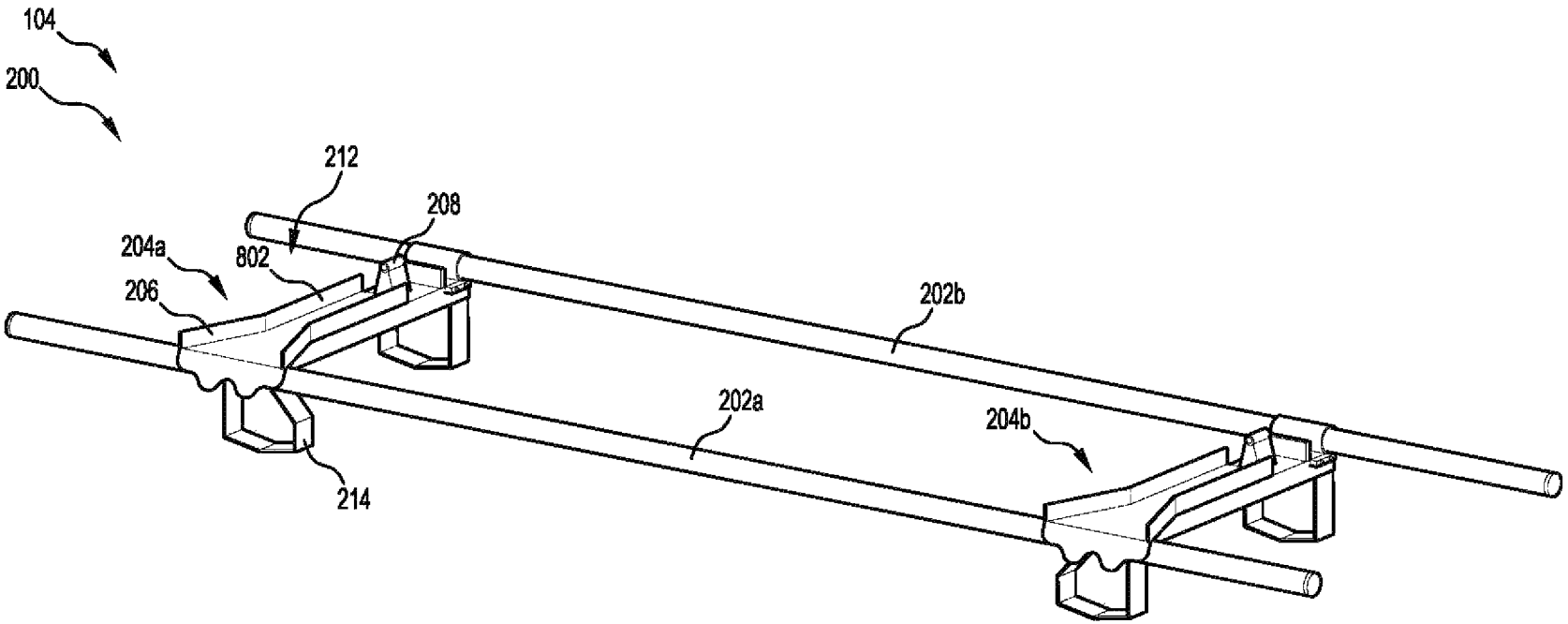
FIG. 2 is a perspective view of an adaptor of the system of FIG. 1.

Turning to FIG. 2, the adaptor 104 includes a frame 200. The frame 200 includes a pair of rails 202*a*, 202*b*, terminating in handles, for extending between cantilevered arms of the racking 106. The adaptor 104 includes a pair of docks 204*a*, 204*b* for docking the stretcher 102 and extending between the rails 202*a*, 202*b*. Each dock 204 includes a tapered guide 206 for guiding the sliding stretcher 102 during loading.

Figure 7:
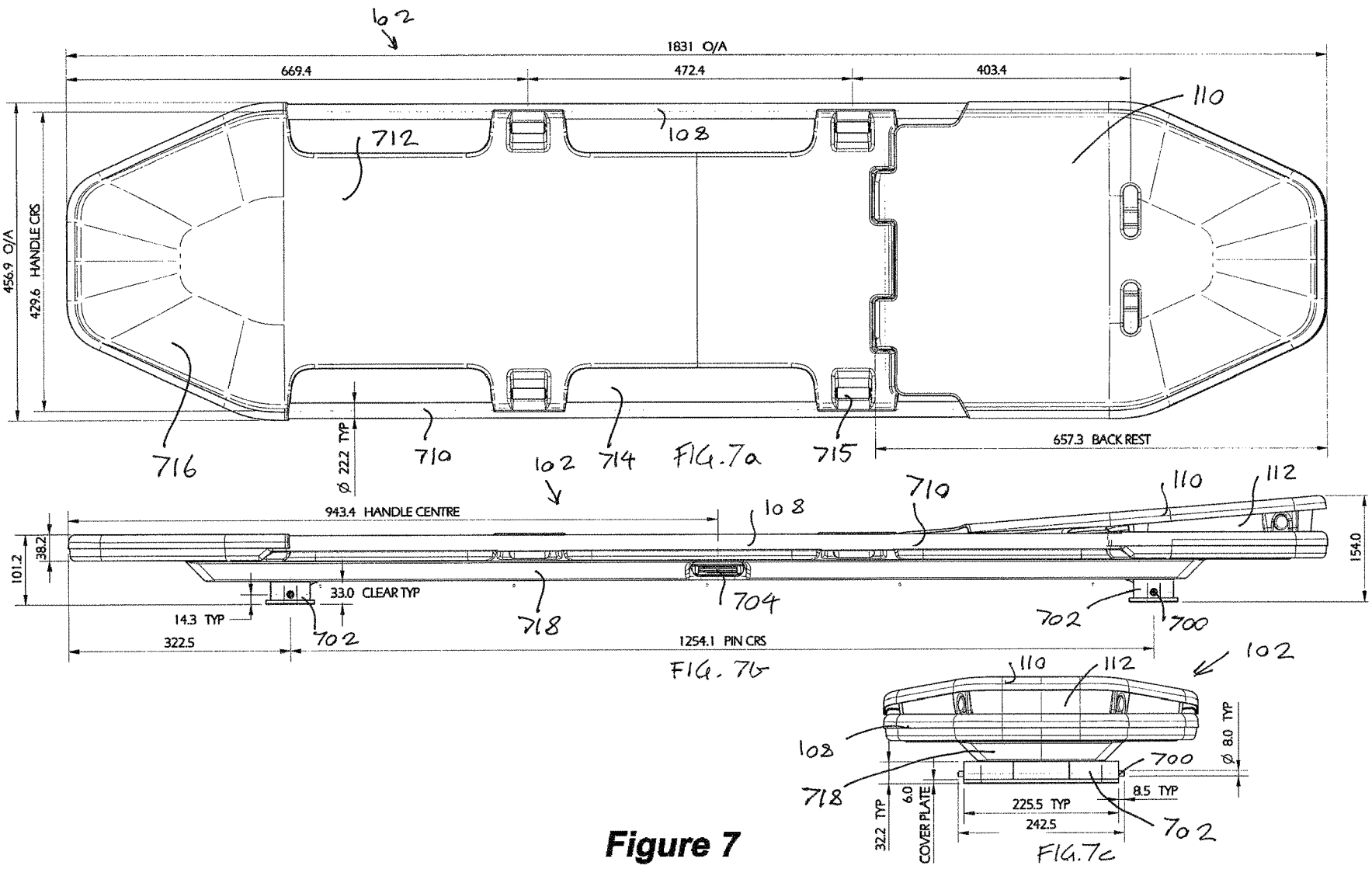
FIG. 7 is an orthographic drawing of a stretcher in accordance with an embodiment of the present invention.
Figure 8:
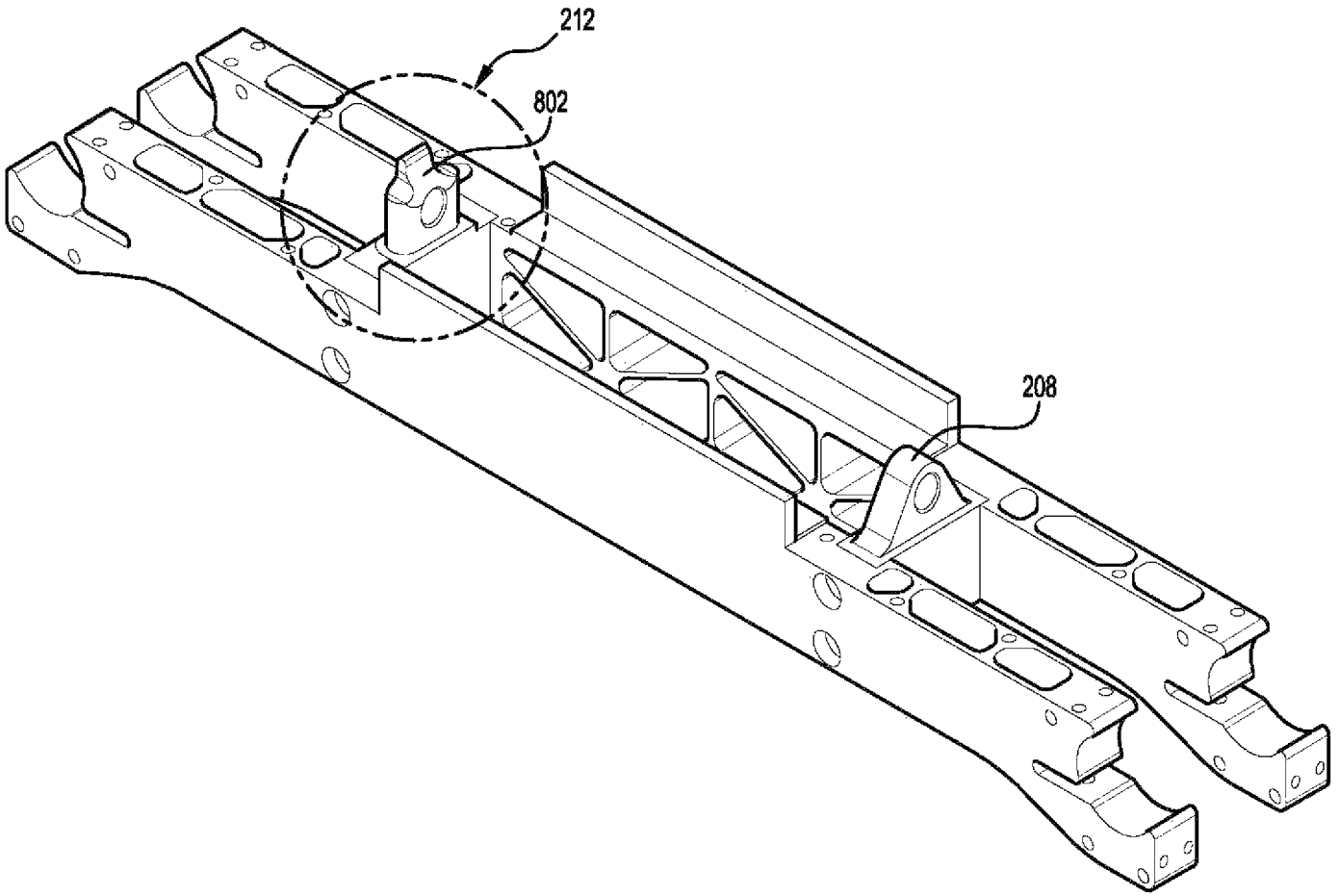
FIG. 8 is a perspective view of an adaptor dock locking arrangement in accordance with an embodiment of the present invention.

As can best be seen in FIG. 8, each adaptor dock 204 forms two male-female fastening arrangements with respective lateral sides of the stretcher 102. A far male-female fastening arrangement includes a female receptacle 208 for complementarily receiving a retractable male locking pin 700 (see FIGS. 7*c* and 9) of the sliding and fully loaded stretcher 102. A near male-female fastening arrangement includes a retractable female receptacle 802 (see FIG. 8) protruding from the topside of the adaptor 104 and complementarily receiving an opposite male locking pin 700 of the stretcher 102.

Each dock 204 includes a locking mechanism 212 for locking the stretcher 102 to the adaptor 104. The locking mechanism 212 includes the locking receptacle 802 for received the near stretcher pin 700. The locking receptacle 802 is spring biased to be retracted and unlocked to facilitate stretcher loading. Once the stretcher 102 is fully slid and loaded into the adaptor 104, a carer can manually push up the locking receptacle 802 so that the locking receptacle 802 protrudes from the adaptor 104.

Figure 9:
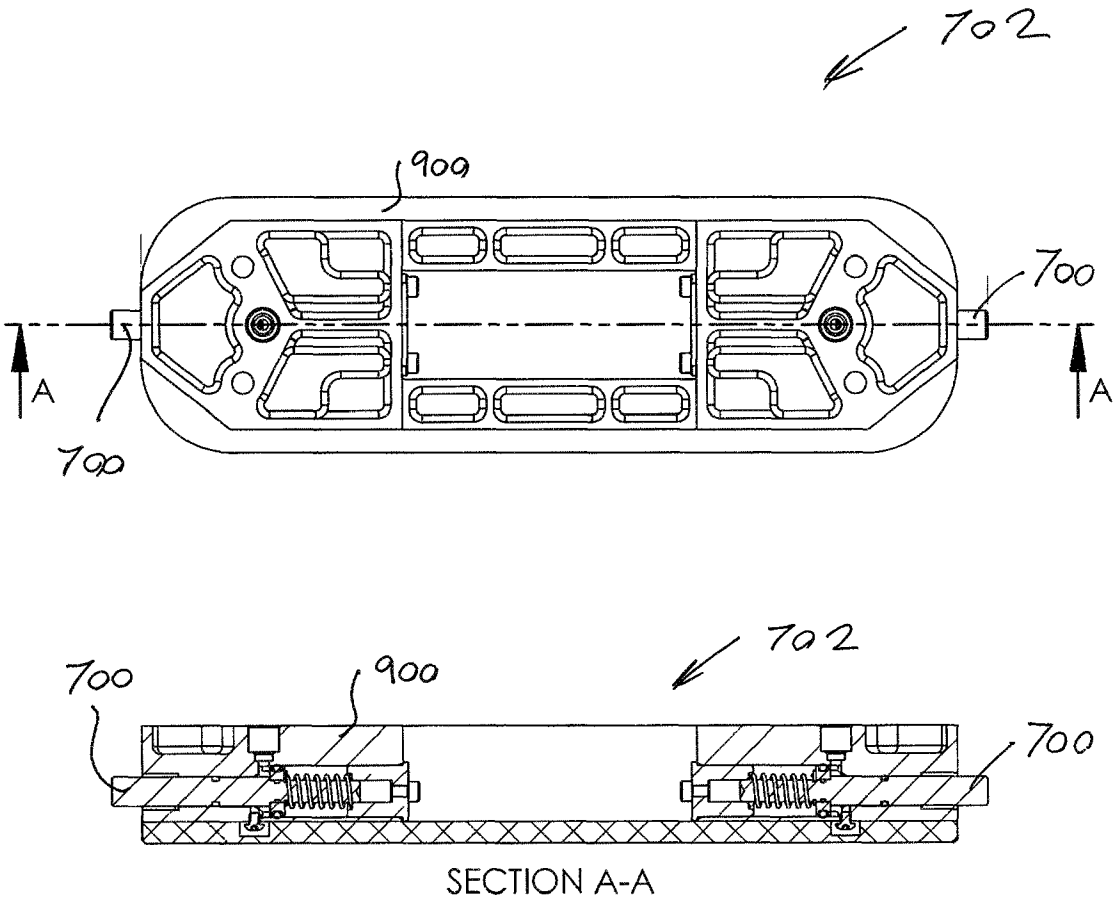
FIG. 9 shows plan and side sectional views of a stretcher locking arrangement in accordance with an embodiment of the present invention.
Figure 10:
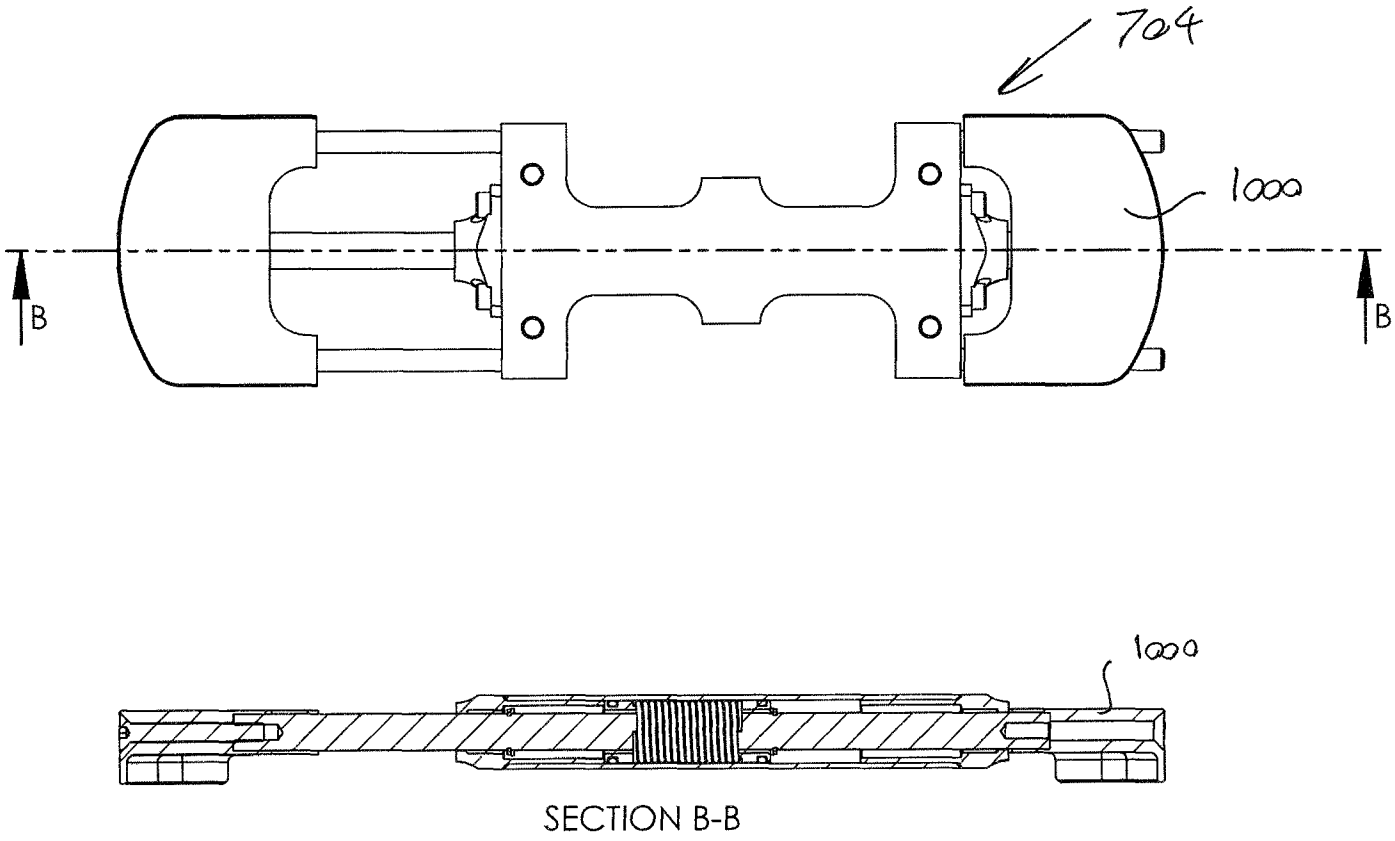
FIG. 10 shows plan and side sectional views of a stretcher locking actuator in accordance with an embodiment of the present invention.

As shown in FIG. 9, the stretcher 102 includes two underside stretcher locking arrangements 702 (see also FIG. 7*b*). Each stretcher locking arrangement 702 includes a static rest 900 which houses the pair of movable pins 700 that are normally spring biased to be extended to facilitate loading of the stretcher 102 in the adaptor 104. The stretcher 102 includes a locking actuator 704 (see FIG. 7*b* and FIG. 10) with spring-loaded pull handle 1000 to actuate a hydraulics supply and protract the stretcher locking pins 700 into the adaptor locking receptacles 208, 802, thereby safely locking the stretcher 102 to the adaptor 104, and also enabling its removal.

The stretcher locking arrangement 702 is hydraulically operated and the complementary adaptor locking mechanism 212 is manually operated independently, although these can alternatively be mechanically, pneumatically or electrically operable, or operated together with a single actuator. The adaptor 104 also includes a quartet of rests 214 extending beneath respective junctions of the rails 202 and docks 204.

Figure 3:
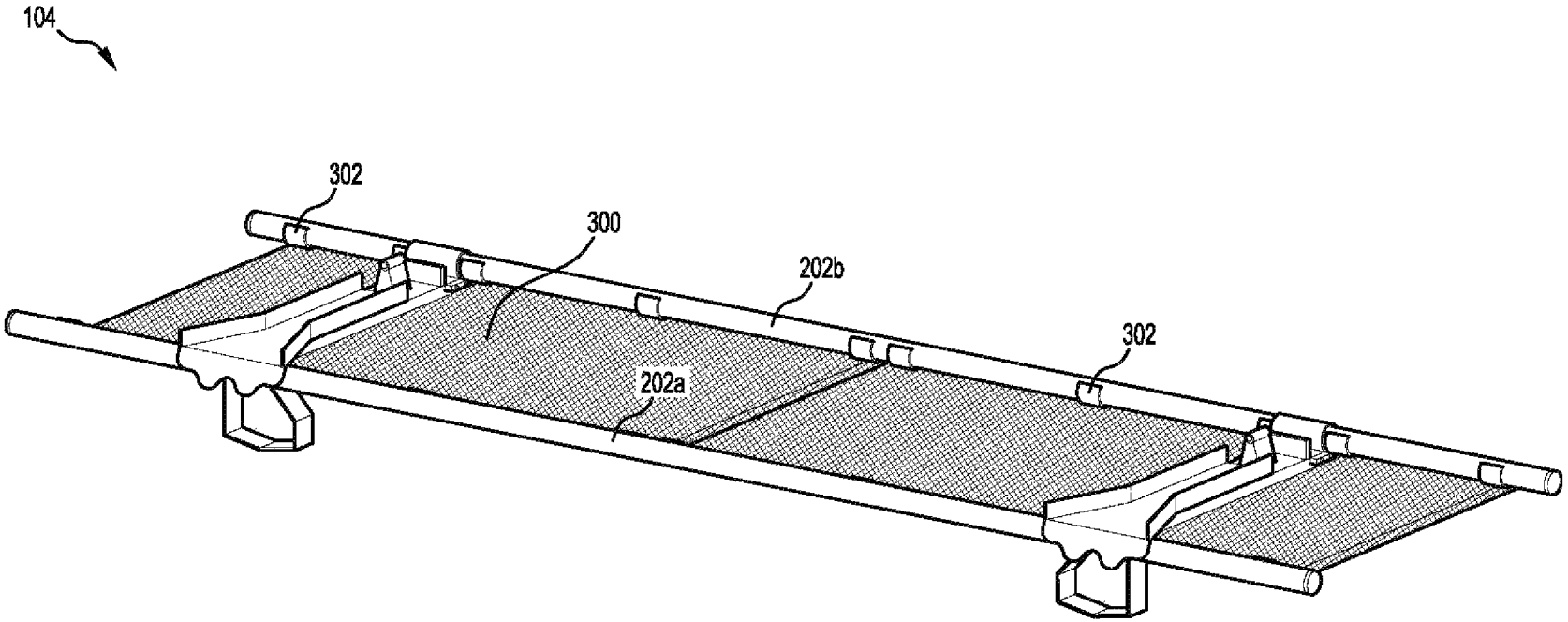
FIG. 3 is a perspective view of the adaptor of FIG. 2 with a shield fitted.

Turning to FIG. 3, the adaptor 104 may include a shield 300 for shielding bullets, shrapnel or other ballistic material coming from below. The shield 300 is releasably fastened to an underside of the adaptor 104. The shield 300 clips to rails 202 of the adaptor 104 using resilient clips 302. The shield includes a sheet which receives replaceable inserts of ballistic protection material. The ballistic protection material may include carbon fibre and/or Kevlar and/or ceramic material of suitable composite construction to protect the patient on the stretcher.

Figure 4:
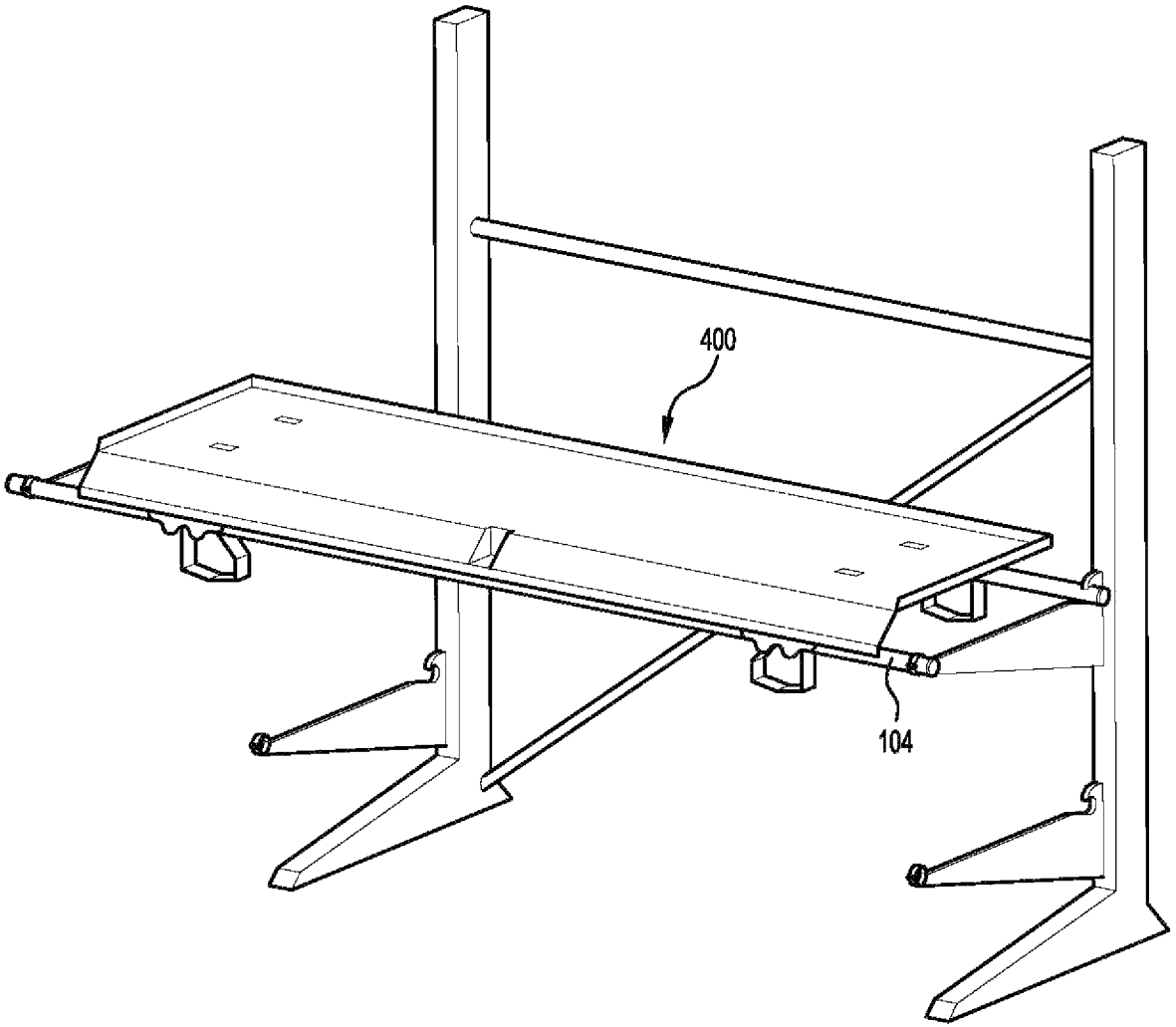
FIG. 4 is a perspective view of the adaptor of FIG. 2 with a workbench fitted.

Turning to FIG. 4, the system 100 further includes a workbench 400 for slidably fastening to the adaptor 104. The workbench 400 is formed from carbon fibre, Kevlar material or metal alloys. The underside of the workbench 400 includes locking arrangements 702 for locking with the adaptor 104 as previously described.

Figure 5:
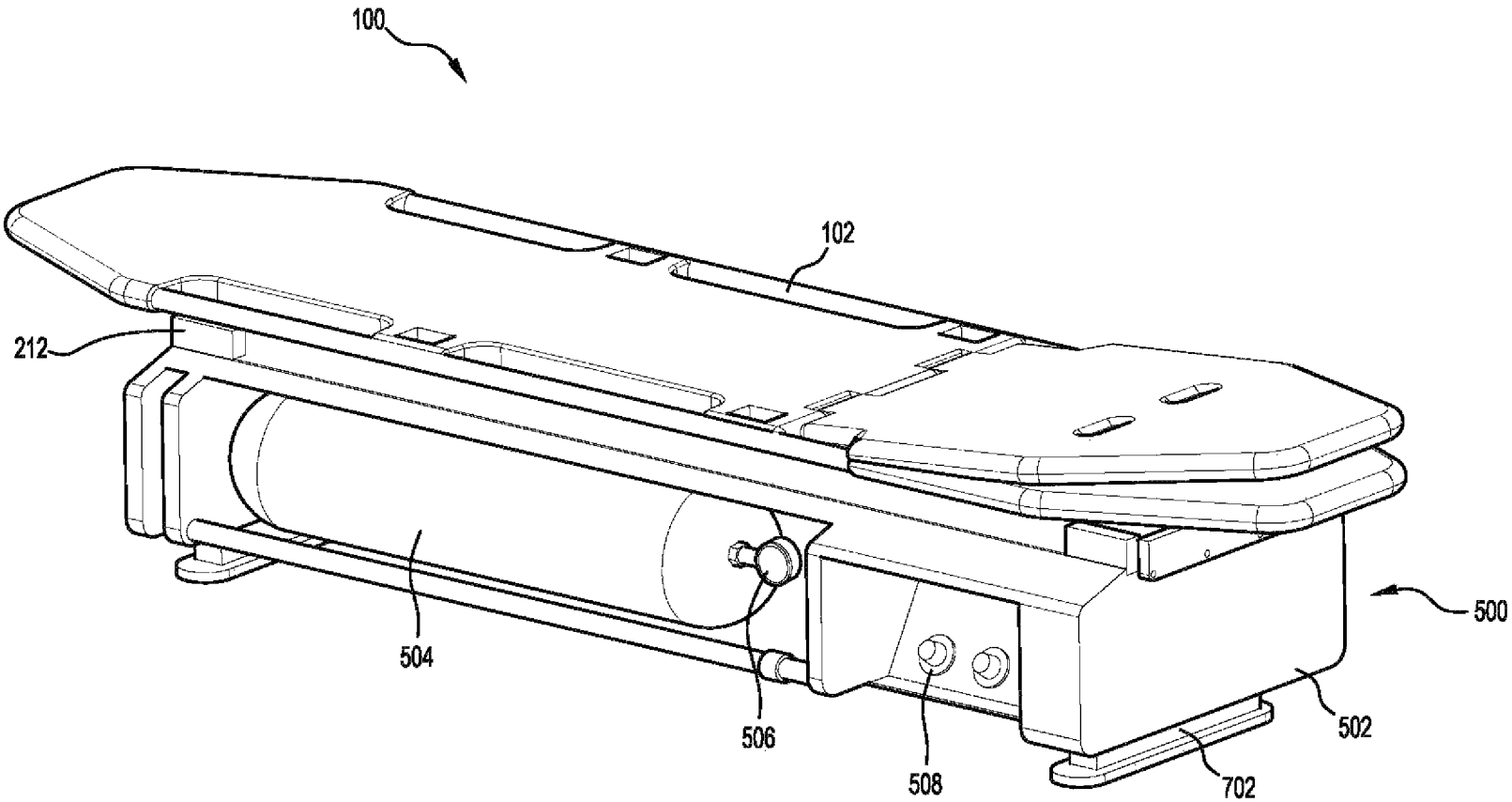
FIG. 5 is a perspective view showing a medical module fastened to a stretcher in accordance with an embodiment.

Turning to FIG. 5 (and also shown in FIG. 1), the system 100 further includes a medical life support module 500 for interconnecting between the adaptor 104 and stretcher 102. Accordingly, the fastening fittings on the top (dock locking mechanisms 212) and bottom (pin locking arrangements 702) of the medical module 500 are the same as those of the adaptor 104 and stretcher 102 respectively. The medical module 500 includes a container 502 for containing a life support system. In particular, the medical module includes an oxygen tank (or tanks) 504 and regulator 506 for supplying oxygen to the patient on the stretcher 102, and a suction system. The medical module 500 also includes a power inverter and a 110V/240V mains power supply 508 with outlets.

Returning to FIG. 1, the aircraft racking 106 includes upper and lower pairs of cantilever arms 114 for supporting the adaptor 104. Each arm 114 includes an end receptacle 116 for receiving respective handles terminating the adaptor rails 202. The racking further includes a pair of uprights 118, a base 120 supporting the uprights 118, and a stabilizer bar 122 stabilizing the uprights 118.

The system 100 is used in aero-medical military evacuations including during natural disasters, but also during battle or war. In use, the adaptor 104 is fastened to aircraft racking. In turn, the medical stretcher 102 carrying the patient is slid into the docks 204 and locked, with locking mechanisms 212, to the adaptor 104 for transport.

FIG. 7 shows the hand-carried stretcher 102 in detail which can be used to carry a patient by hand. The stretcher chassis 108 includes a carbon fibre composite outer frame rails 710, and a carbon fibre composite patient support 712 attached to the frame adjacent the pivoting rest 110. The impermeable carbon fibre composite support 712 is more readily cleaned and more sanitary than fabric of NATO type-stretchers. The patient support 712 includes four handle cutouts 714 defining four side handles, with two handles on either side for respective stretcher bearers on either side to grab. A foot end pocket 716 is provided for receiving an end of the outer frame rails 710. Modern multi-point seatbelts can advantageously pass through the four seatbelt cutouts 715 to secure the patient to the stretcher 102.

As can best be seen in FIG. 7*b*, the patient support 712 does not cover the centre region of the frame 710, which is under most duress, and advantageously allows ready visual inspection of the exposed frame 710 for damage.

As can best be seen in FIG. 7*c*, the stretcher 102 includes a carbon fibre composite undercarriage 718 extending along the length of the underside of the chassis 108 and patient support 712. The locking actuator 704 is mounted in the undercarriage 718, and the locking arrangements 702 are mounted beneath the undercarriage 718.

Figure 11:
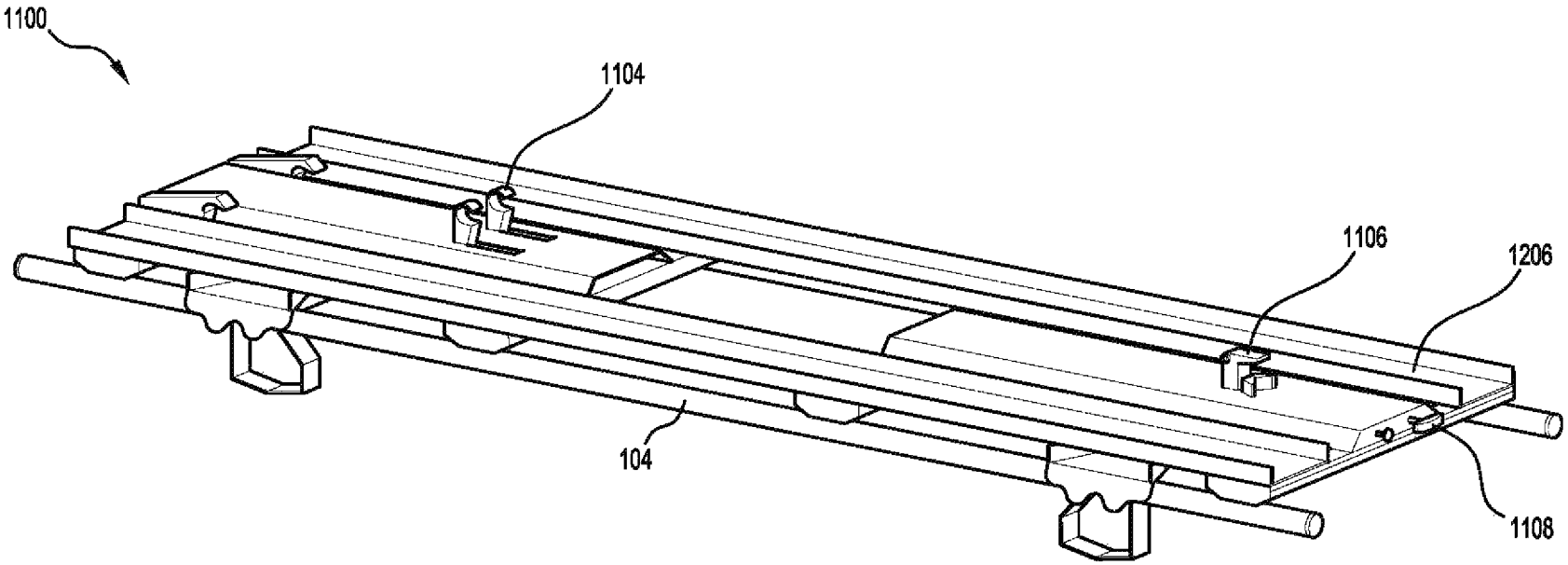
FIG. 11 shows a perspective view of another adaptor for adapting a non-military stretcher to fasten to the adaptor of FIG. 2.
Figure 12:
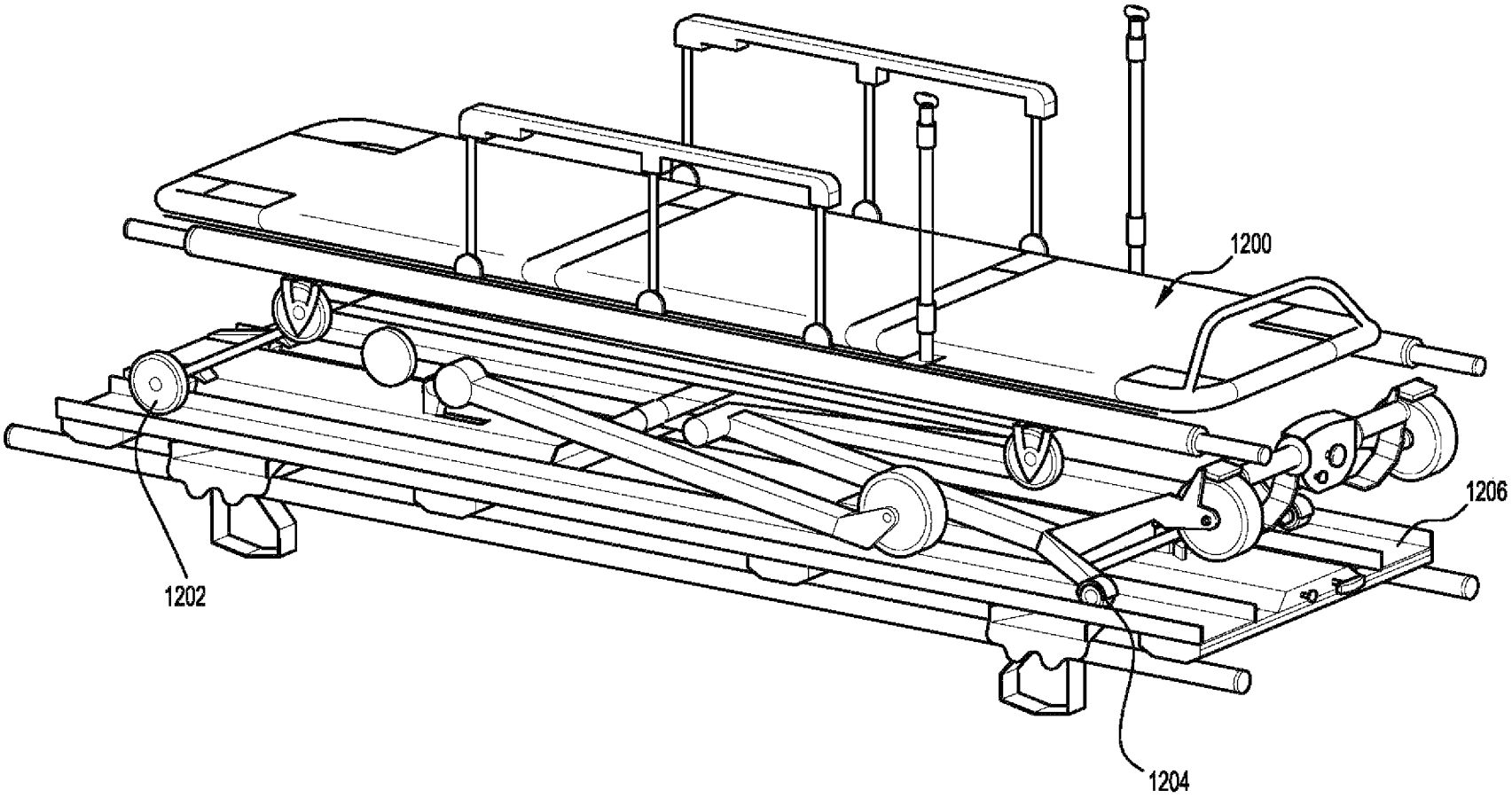
FIG. 12 shows a non-military stretcher fastened to the other adaptor of FIG. 11.

Turning to FIGS. 11 and 12, the system 100 further includes another top plate-like adaptor 1100 for adapting a non-military stretcher 1200 (e.g. conventional civilian stretcher) to fasten to the military adaptor 104. The adaptors 104, 1100 form a locking arrangement, including previously described dock locking mechanism 212 (FIG. 8) and complementary locking arrangement 702 (FIG. 9), for releasably locking together.

The top adaptor 1100 includes a linear guide for guiding wheels 1202, 1204 of the non-military stretcher 1200. The guide includes a pair of channel rails 1206 and may include releasable ramps extending from respective channels 1206.

The top adaptor 1100 also includes a fastening mechanism for fastening the non-military stretcher 1200. In particular, the fastening mechanism includes a pair of fixed rear fasteners 1102, a pair of intermediate retractable fasteners 1104 and a front retractable fastener 1106. Each fastener is a catch or hooked for catching on a bar of the non-military stretcher 1200. The top adaptor 1100 also includes a hydraulic pull actuator 108 for protracting the retractable fasteners 1104, 1106.

The fastening mechanism of the top adaptor 1100 of FIG. 11 is suitable for fastening to many types of civilian stretchers 1200. The fastening mechanism can be arranged to suit various other types of civilian stretchers including Ferno, Stryker and DHS brand stretchers.

A person skilled in the art will appreciate that many embodiments and variations can be made without departing from the ambit of the present invention.

Figure 6:
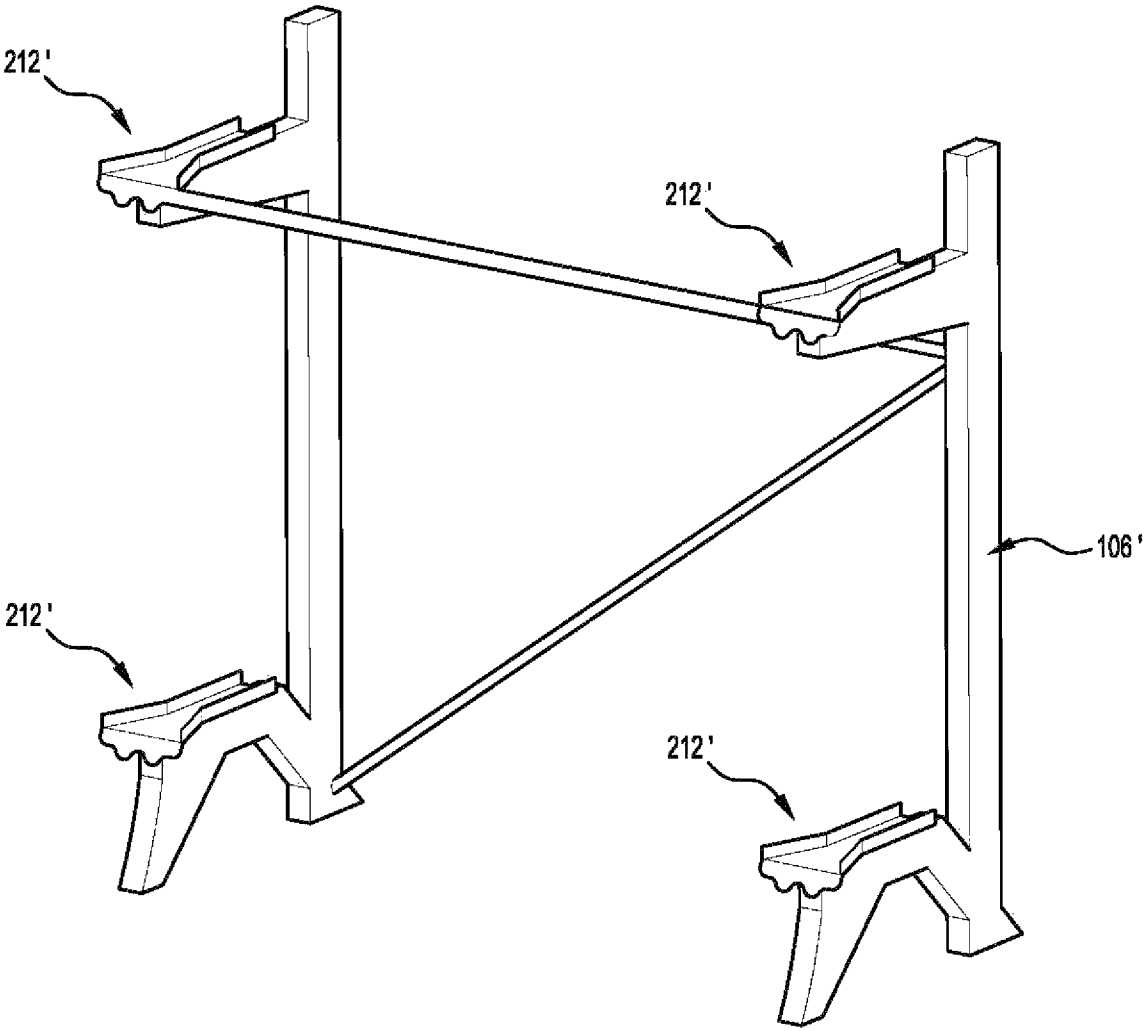
FIG. 6 is a perspective view showing aero-medical racking in accordance with another embodiment of the present invention.

In one embodiment, purpose built aircraft racking 106' may include the adaptor docks 212' as shown in FIG. 6.

In compliance with the statute, the invention has been described in language more or less specific to structural or methodical features. It is to be understood that the invention is not limited to specific features shown or described since the means herein described comprises preferred forms of putting the invention into effect.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

The claims defining the invention are as follows:

1. A military stretcher system including:

a military hand-carried stretcher releasably fastenable with a hand-carried adaptor; and the hand-carried adaptor releasably fastenable with the stretcher and for adapting the hand-carried stretcher to fasten to upper racking, or lower racking beneath the upper racking, of a stretcher holder located permanently within a military transportation vehicle;

wherein the hand-carried adaptor includes a frame comprising a first rail and a second rail extending between arms of the stretcher holder, a first dock and a second dock affixed to and extending between the first rail and the second rail, with each of the first dock and the second dock including a tapered guide disposed proximate to the first rail and configured for guiding the military hand-carried stretcher when fastening to the hand-carried adaptor, and a locking mechanism configured for locking the military hand-carried stretcher to the hand-carried adaptor;

wherein the first rail includes a first static handle extending from the first dock to a first distal end of the first rail, and a second static handle extending from the second dock to a second distal end of the first rail;

wherein the second rail includes a first static handle extending from the first dock to a first distal end of the second rail, and a second static handle extending from the second dock to a second distal end of the second rail;

wherein the first handle and the second handle of the respective first rail and the second rail are configured to be received within receptacles of the stretcher holder of the military transportation vehicle.

2. The military stretcher system as claimed in claim 1, wherein the stretcher includes carbon fibre material or carbon fibre composite materials.

3. The military stretcher system as claimed in claim 1, wherein the upper racking or the lower racking includes aircraft racking.

4. The military stretcher system as claimed in claim 1, wherein the military hand-carried stretcher is a NATO stretcher.

5. The military stretcher system as claimed in claim 1, wherein the military hand-carried stretcher further includes a backrest or a headrest.

6. The military stretcher system as claimed in claim 5, wherein the military hand-carried stretcher includes a lifter for lifting the rest to an inclined position.

7. The military stretcher system as claimed in claim 1, wherein the the locking mechanism includes at least one male-female fastening arrangement for locking the military hand-carried stretcher to the hand-carried adaptor.

8. The military stretcher system as claimed in claim 1, wherein the hand-carried adaptor includes a ballistic shield for shielding ballistic material.

9. The military stretcher system as claimed in claim 1, further including a medical life support module for interconnecting between the hand-carried adaptor and the military hand-carried stretcher.

10. The military stretcher system as claimed in claim 1, further including a workbench for fastening to the hand-carried adaptor.

11. A military stretcher hand-carried adapter, comprising:

a first rail and a second rail;

a first dock and a second dock affixed to and extending between the first rail and the second rail, with each of the first dock and the second dock including a tapered guide disposed proximate to the first rail;

a locking mechanism configured for locking a military stretcher to the first dock and the second dock;

wherein the first rail includes a first static handle extending from the first dock to a first distal end of the first rail, and a second static handle extending from the second dock to a second distal end of the first rail;

wherein the second rail includes a first static handle extending from the first dock to a first distal end of the second rail, and a second static handle extending from the second dock to a second distal end of the second rail;

wherein the first handle and the second handle of the respective first rail and the second rail are configured to be received within receptacles of a stretcher holder of a military transportation vehicle.

12. The military stretcher hand-carried adapter of claim 11 wherein the first rail, the second rail, the first dock and the second dock include carbon fibre material or carbon fibre composite materials.

13. The military stretcher hand-carried adapter of claim 11 wherein the stretcher holder of the military transportation vehicle includes an aircraft racking.

14. The military stretcher hand-carried adapter of claim 11 wherein the first dock, the second dock and the locking mechanism are configured to fasten to a NATO stretcher.

15. The military stretcher hand-carried adapter of claim 11 wherein the locking mechanism includes at least one male-female fastening arrangement.

16. The military stretcher hand-carried adapter of claim 11 further comprising a ballistic shield disposed between the first rail and the second rail and beneath the first dock and the second dock.

17. The military stretcher hand-carried adapter of claim 11 further comprising a medical life support module configured to connect to the first dock and the second dock.

18. The military stretcher hand-carried adapter of claim 11 further comprising a workbench configured to connect to the first dock and the second dock.

* * * * *